US006868691B2

(12) United States Patent
Guerra

(10) Patent No.: US 6,868,691 B2
(45) Date of Patent: Mar. 22, 2005

(54) ILLUSIONARY SNOW APPARATUS WITH REDUCED NOISE

(76) Inventor: Francisco Guerra, 3841 County Rd. 93, Anderson, AL (US) 35610

( * ) Notice: Subject to any disclaimer, the term of this patent is extended or adjusted under 35 U.S.C. 154(b) by 0 days.

(21) Appl. No.: 10/672,325

(22) Filed: Sep. 26, 2003

(65) Prior Publication Data

US 2004/0056110 A1 Mar. 25, 2004

Related U.S. Application Data

(63) Continuation-in-part of application No. 10/287,413, filed on Nov. 4, 2002, now abandoned, which is a continuation-in-part of application No. 09/996,175, filed on Nov. 20, 2001, now Pat. No. 6,474,091, which is a continuation-in-part of application No. 09/664,271, filed on Sep. 18, 2000, now Pat. No. 6,321,559.

(51) Int. Cl.[7] ..... F25C 1/00

(52) U.S. Cl. ..... 62/347; 239/2.2

(58) Field of Search ..... 62/347, 74; 239/2.2, 239/14.2

(56) References Cited

U.S. PATENT DOCUMENTS

| | | | | | |
|---|---|---|---|---|---|
| 4,326,388 | A | * | 4/1982 | McFee | 62/324.6 |
| 4,444,024 | A | * | 4/1984 | McFee | 62/401 |
| 4,593,854 | A | * | 6/1986 | Albertsson | 239/14.2 |
| 4,597,524 | A | * | 7/1986 | Albertsson | 239/14.2 |
| 4,889,180 | A | * | 12/1989 | Sloan | 165/263 |
| 5,004,151 | A | * | 4/1991 | Dupre | 239/2.2 |
| 5,026,432 | A | * | 6/1991 | Johnson | 134/21 |
| 5,180,105 | A | * | 1/1993 | Teague | 239/14.2 |
| 5,400,966 | A | * | 3/1995 | Weaver et al. | 239/2.2 |
| 5,836,513 | A | * | 11/1998 | Smith et al. | 239/2.2 |
| 5,836,514 | A | * | 11/1998 | Handfield | 239/14.2 |
| 6,029,468 | A | * | 2/2000 | Ferris et al. | 62/347 |
| 6,554,200 | B1 | * | 4/2003 | Satonaka | 239/2.2 |

FOREIGN PATENT DOCUMENTS

| | | | |
|---|---|---|---|
| DE | 004226890 | A1 * | 1/1994 |
| JP | 2000154955 | A * | 6/2000 |

* cited by examiner

*Primary Examiner*—William E. Tapolcai
*Assistant Examiner*—Mohammad M. Ali
(74) *Attorney, Agent, or Firm*—David W Barman

(57) ABSTRACT

A Machine and method for producing the illusion of snow is disclosed and described. It produces said product in a manner such that is easier to manufacture, operate, and produce than is currently available.

8 Claims, 8 Drawing Sheets

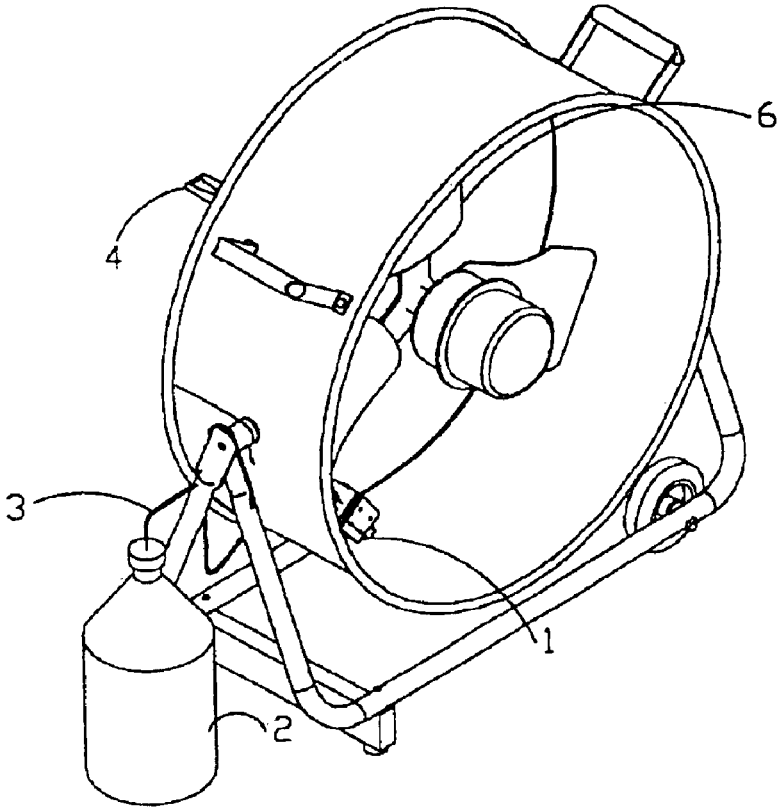
FIG 1
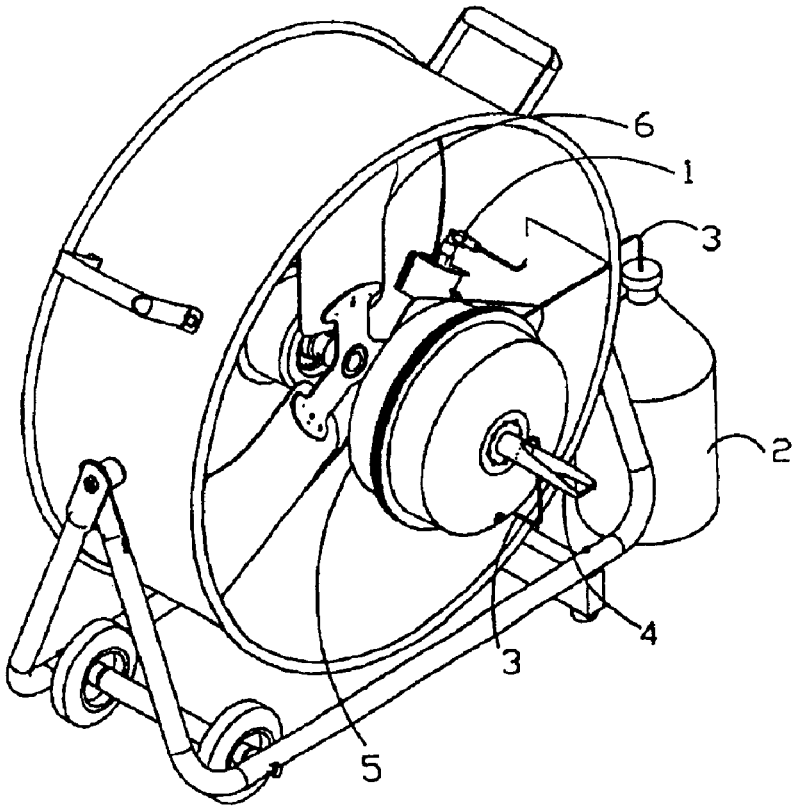

ILLUSIONARY SNOW APPARATUS WITH REDUCED NOISE

CROSS REFERENCE TO RELATED APPLICATIONS

This is a continuation-in-part of patent application Ser. No. 10/287,413 filed Nov. 4, 2002 now abandoned, which is a continuation-in-part of patent application Ser. No. 09/996,175 filed Nov. 20, 2001 now U.S. Pat. No. 6,474,091, which is a continuation-in-part of patent application Ser. No. 09/664,271 filed Sep. 18, 2000, now U.S. Pat. No. 6,321,559.

FIELD OF THE INVENTION

This invention relates to the production of illusionary snow. More particularly, a machine which capable of creating the illusion of snow for theatrical or special effect purposes without the use of refrigeration, and without causing the accumulation of any residual moisture in the area in which it is used and which has reduced operating noise

BACKGROUND OF THE INVENTION

The world of theater and special effects has prided itself on the ability to create illusions. The masters of this art are continually creating their magic for the entertainment of their patrons. One of the most challenging illusions is that of snow. This presents a distinct difficulty. Limitations based on temperature and accumulation of moisture have always plagued the special effects creators.

There are many commercially available machines for producing snow. Many of these liquid based snow machines have been able to produce artificial snowflakes. The flakes formed were tight groupings of bubbles that were moist and had a tendency to clump together. This caused difficulty in dissipation. Additionally, there were concerns regarding moisture buildup in the area in which the machine was used. The problems of slippery floors, surfaces, and staining from the product have not been overcome. In an attempt to overcome these problems, people have attempted the use of fans in order to more widely distribute the artificial snow produced by these earlier machines. However, the flakes tend to form agglomerates which are not substantially effected by the auxiliary fans. These auxiliary fans do not overcome the physical difficulty of moisture buildup or the danger, which it presents.

The current invention overcomes these deficiencies. It provides for the creation of illusionary snow by an apparatus that utilizes a solution, which is commercially available as FG-100 Evaporative Snow (manufactured by Snow Masters, Plantation Fla.) drawn into a turbulent carrier wave of air at the same point at which the flakes are produced. The preciseness of placement of the carrier wave prevents tight clumps from forming, and causes greater separation between the flakes. Once the individualized flakes are carried from the machine, the evaporative process occurs and prevents moisture buildup. It has now been shown that evaporative snow may be produced with machine emitting reduced operating noise.

SUMMARY OF THE INVENTION

A machine for producing an evaporative snow as small individualized particles which are easily dispersed, are free from agglomerates and leave no moisture and residue in the area of use, said machine comprised of a pump to deliver evaporative snow solution to a flake generator comprising of an impeller or impellers which causes the flakes to form on the surface of a sock, said flakes are dispersed by a sock by a airflow of 500–3000 cubic feet per minute, created by said impeller (s) and produces external noise levels up to around 90 decibels measured three feet from the machine.

In one embodiment the machine produces external noise levels are between about 50-80 decibels measured three feet from the machine.

In yet another embodiment the machine produces external noise levels are between about 50–70 decibels measured three feet from the machine.

In yet another embodiment the machine produces external noise levels are between about 50–60 decibels measured three feet from the machine.

The machine reduces external noise through:

(a) directing air flow to a plastic duct;

(b) sealing the duct with foam;

(c) containing the fan in the duct in a non rigid mounting;

(d) and by using special sized and shaped foam baffles to reflect and absorb noise energy, that are rotated to counteract a particular fan frequency.

The foam may be any acoustical foam as is commonly known.

The machine may use multiple fans for generating the air flow.

The machine may use various discharge nozzle or air portal shapes to reduce noise for evaporative snow production.

The machine may use modified outer case material, size, shape or insulation properties to reduce noise for evaporative snow generation.

BRIEF DESCRIPTION OF THE DRAWINGS

FIG. 1 shows a complete illusionary snow machine that incorporates all of the aspects of the invention.

DETAILED DESCRIPTION OF THE PREFERRED EMBODIMENT

Figure 2:
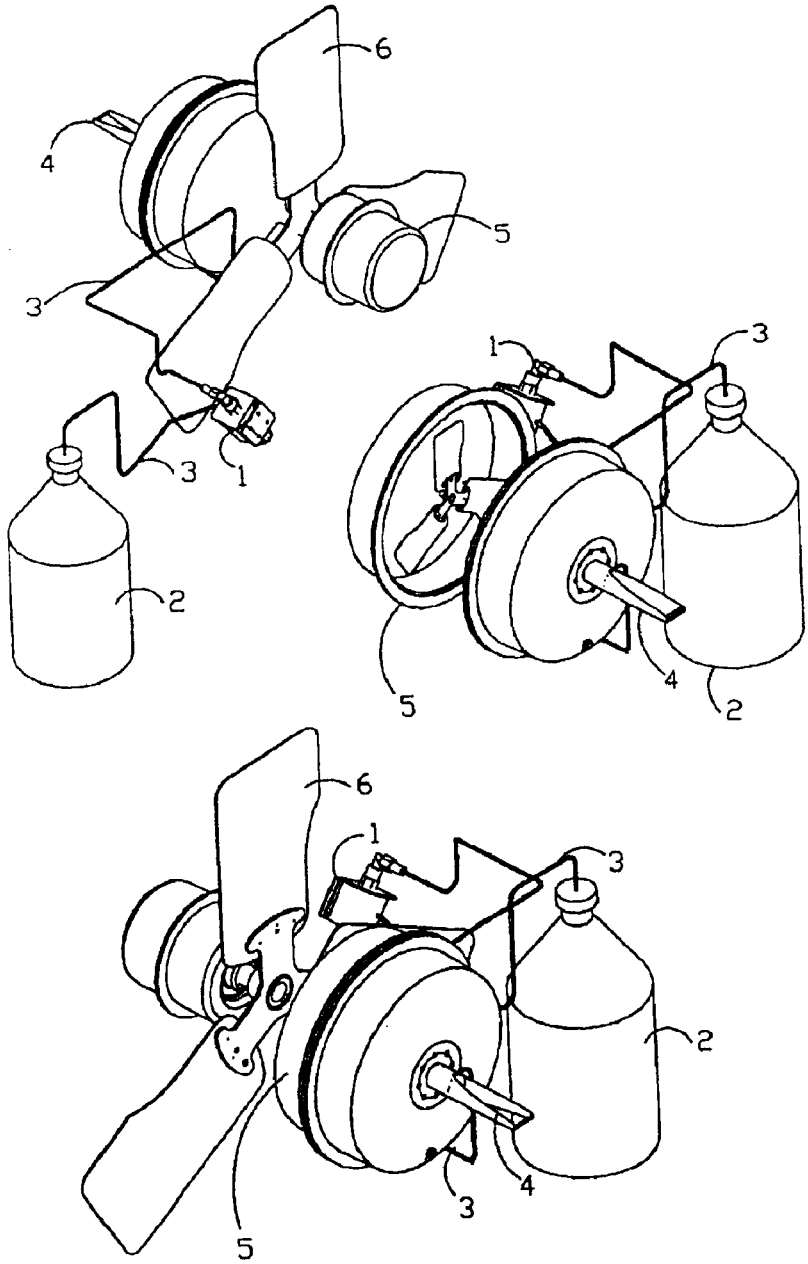
FIG. 2 illustrates the pump with connecting hose and the flake generator.

The ilusionary snow solution 2 under pressure is drawn into connecting hose 3 by means of an in-line liquid pump 1 at a rate of 4 ounces per minute. The liquid then continues to a flake generator 7 where it saturates a sock 4. An impeller 5 contained within flake generator 7 causes flakes to form and to be projected into the air while an integrated carrier fan 6 facilitates the distribution of individual flakes. The flake generator 7 will produce a constant 3000 cubic feet per minute of airflow. This volume of air is forced through sock 4 and holes 8, which are on the outer surface of flake generator 7. Pressure of the air coming through sock 4 causes flakes to be formed on the outer surface of said sock 4. The volume of air produced by impeller 5 that exits flake generator 7 through the holes 8 lift the flakes from the surface of sock 4. Once the flakes are lifted from sock 4, they are projected away from the apparatus by means of airflow produced by carrier fan 6. When the force of air contacts the flakes produced carrier fan 6 there are two physical phenomena that occur. First the flakes are broken into smaller particles. This is a novel part of the current invention. The other commercially available machines have a great tendency to produce larger agglomerates, which in turn lead to excessive moisture buildup in the surrounding area. Second, once the flakes are separated into smaller particles, they are more easily dispersed in the area away from the machine. Once they are in the air in this matter the overall ratio of surface area exposed to air greatly increases. With this increased surface are comes a greater ability to speed the evaporative process. These two factors combine to speed the evaporative process and make it more complete. Another novelty of the current invention lies in the design of carrier fan 6 being lined up with flake generator 7 to lift the flakes and eject them from the apparatus in a manner that is greatly increased then a machine that would not contain both of these features placed together and at a proper distance from one another. This allows the flakes to remain in the air for a longer period of time and thus increases the transit time before they reach the ground. This increased time provides more exposure to air and allows for the completeness of evaporation to occur. The final result is an evaporative artificial snowfall that is truly free from residue of any type. Additionally, the snow produced does not resemble typical artificial snow that is ejected from a carrier hose or other apparatus. The current invention lifts the illusionary snow in a manner that produces a gentle cloud of snow in a wider horizontal area. The individualized flakes provide a cloud of gently falling flakes that is truly more realistic than anything currently available.

In one embodiment it has been found that one need not place the carrier fan in a centered position behind the flake generator. It has further been discovered that when placing a drum fan outlet below the flake generator and sock, one can produce a greater amount of illusionary snow, without increasing the velocity of the air from the carrier fan. In using a drum fan with the current invention, it has been discovered that a very large volume of illusionary snow can be produced. The volume is such that this embodiment allows the subject invention to be used in large arenas and stadiums. The same velocity of 3000 cubic feet per minute will generate a noticibly increased amount of illusionary snow. This is an important feature because without the need or increased air velocity, there is no increase in any noise created by the apparatus. If the apparatus were to be used indoors eg. in the theater, the amount of noise created would be minimal. Additionally, with the increased efficiency comes the ability of the user to regulate the flow rate of the solution into the apparatus. The solution can have a flow rate between 1–4 ounces per minute and still produce illusionary snow.

Figure 3:
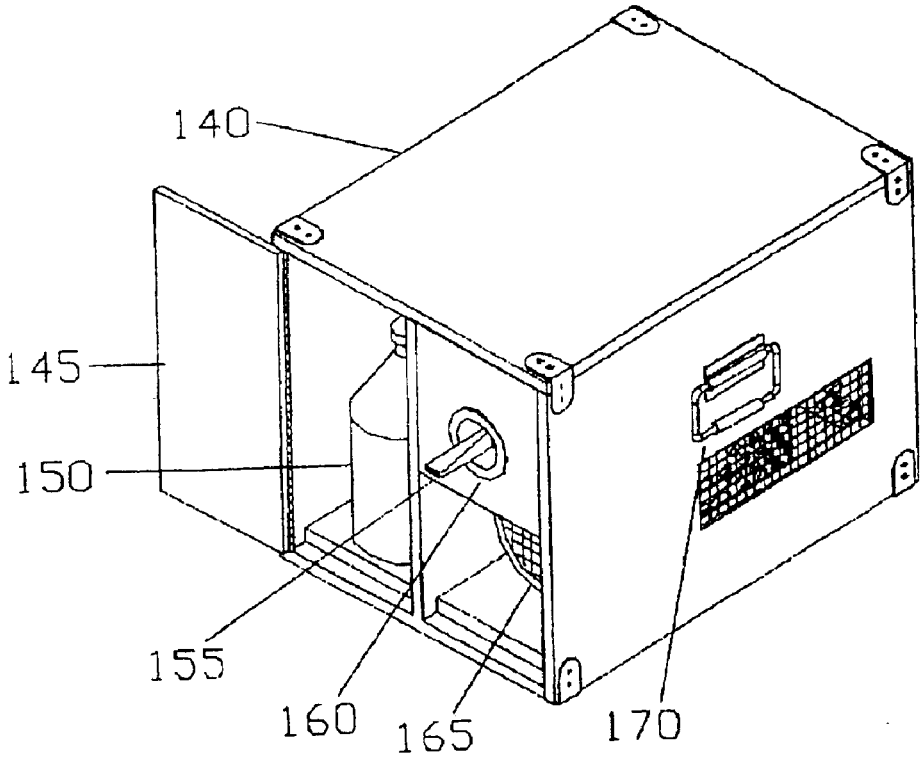
FIG. 3 illustrates a front view of the apparatus

FIG. 3 illustrates an embodiment with apparatus housed within a case 140 which has a handle 170 on either side to facilitate carrying. A container 150 for holding the solution is placed inside when opening door 145. The sock 155 as previously described is mounted on the front upper portion of the apparatus. An outlet air exhaust 165 provides air from the carrier fan.

Figure 4:
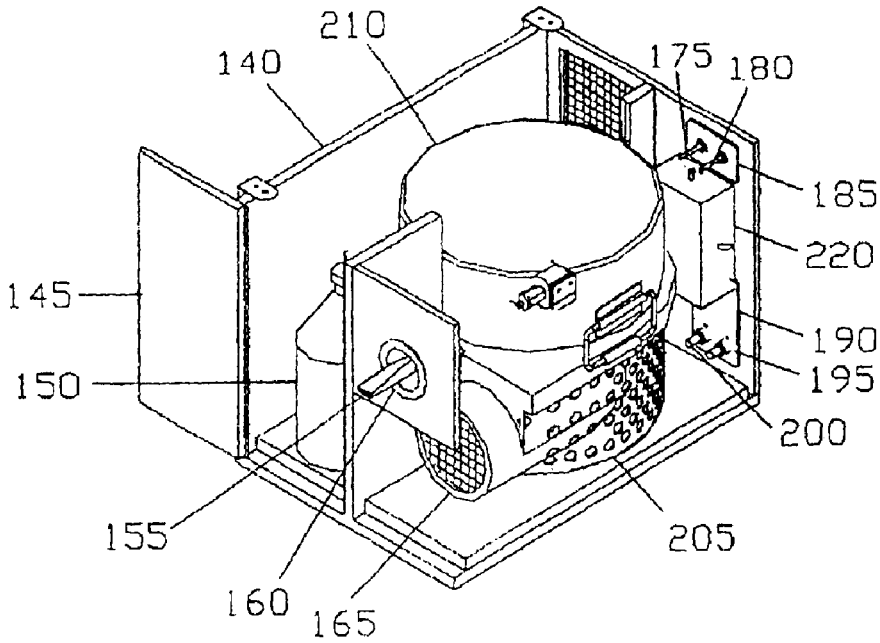
FIG. 4 illustrates the apparatus in a cut away from the front

FIG. 4 shows the interior of the case 140 in which a drum fan 205 as is comonly known in the art, is used to produce the necessary velocity to project the illusionary snow from the apparatus. There is a plate 185 for holding inlets 175 and 185 through which a remote control means can be connected to operate the apparatus. The circuit board 220 receives electrical power from either electrical inlet 195 or 200 which are secured to case 140 by means of a connecting plate 190 and can be controlled through a suitable controlling means as connected to either connector 175 or 180.

Figure 5:
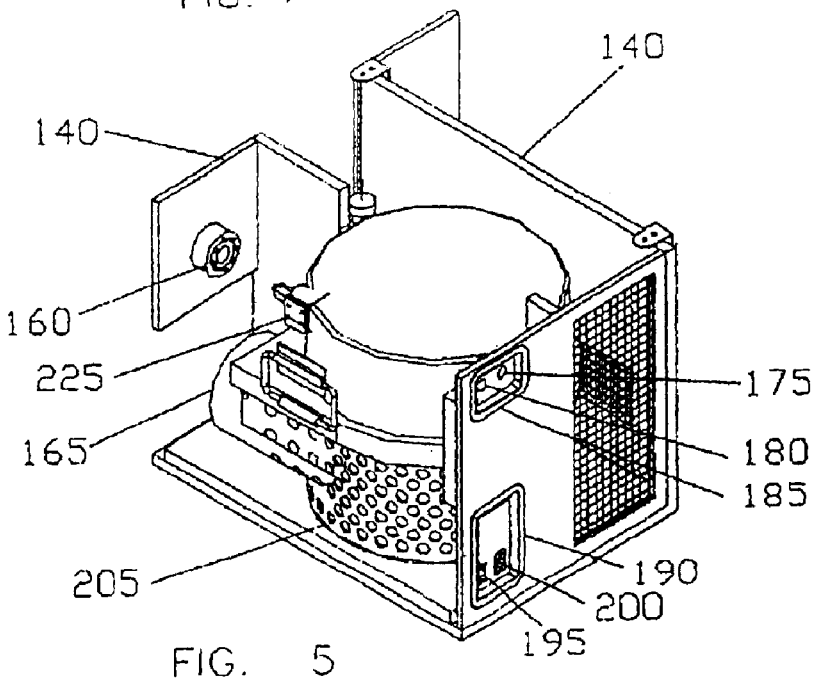
FIG. 5 illustrates the apparatus in a cut away from the rear

FIG. 5 illustrates the aforementioned elements, and additionally shows placement of the flake generator 160 and the pump 225.

The method for producing an illusionary snowfall which employs an evaporative snow solution, is a method comprising the steps of: Supplying electricity to the unit and drawing said evaporative snow solution into an apparatus through a hose, which is connected to a pump, directing said solution from said pump to a flake generator, which forms flakes on the outer surface of a sock, said flake generator comprises an impeller which disperses evaporative snowfall away from the apparatus, and a carrier fan which provides added velocity in projecting the illusionary snow from the apparatus.

Figure 6:
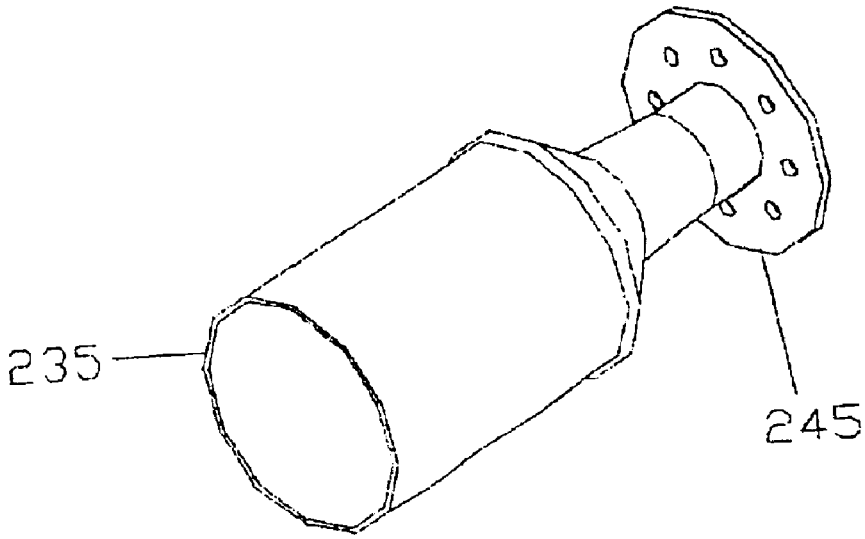
FIG. 6 is a foam streamer attachment
Figure 7:
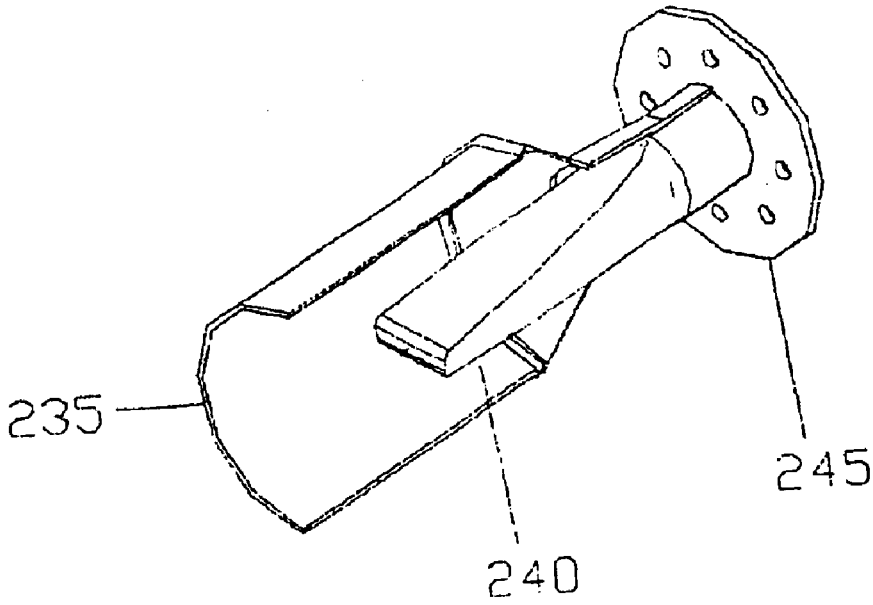
FIG. 7 illustrates the foam streamer in a cut away

In a further embodiment of the subject invention it has been discovered that if one prevents the air from the holes on the outer surface of the flake generator, from reaching the sock, the illusionary snow will be produced in larger form as opposed to individual flakes. FIG. 6 illustrates an attachment which is connected to the outside of the flake generator and prevents the air from the holes on the outside of the flake generator from removing individualized flake. The air flow from the flake generator that reaches the sock, creates a solid form. In this embodiment, a cylindrical sheild 235 prevents air from the holes on the outer surface of the flake generator 245 from reaching the sock. FIG. 7 shows the position of a sock 240 within the cylindrical shield. In this embodiment, the cylindrical sheild produces long cylindical columns of illusionary snow. These long cylindrical columns are carried from the sock by air that reaches the sock from the flake generator. Once the cylindrical column exits the cylindrical shield, the carrier fan propels it away from the apparatus. One can make the shield in various shapes in order to change the shape of the column.

Figure 8:
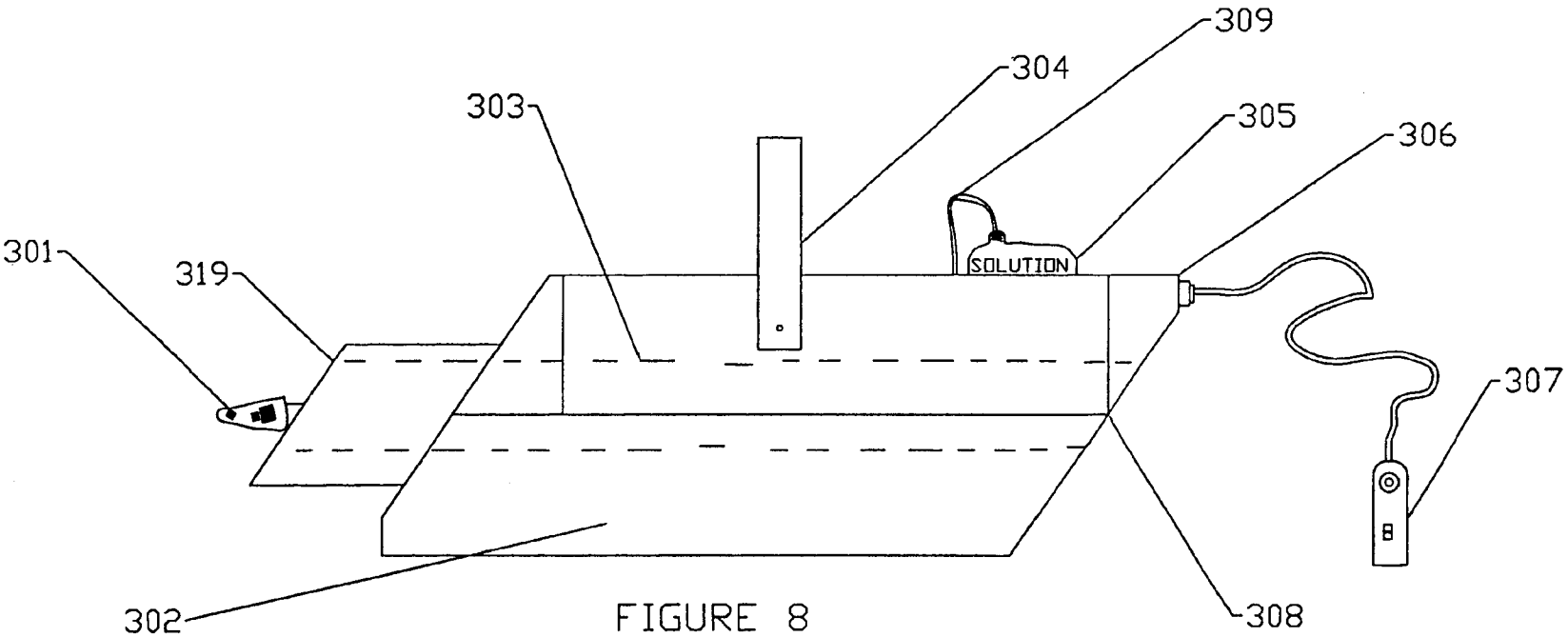
FIG. 8 shows the side view of outer case of the low noise illusionary snow machine.
Figure 9:
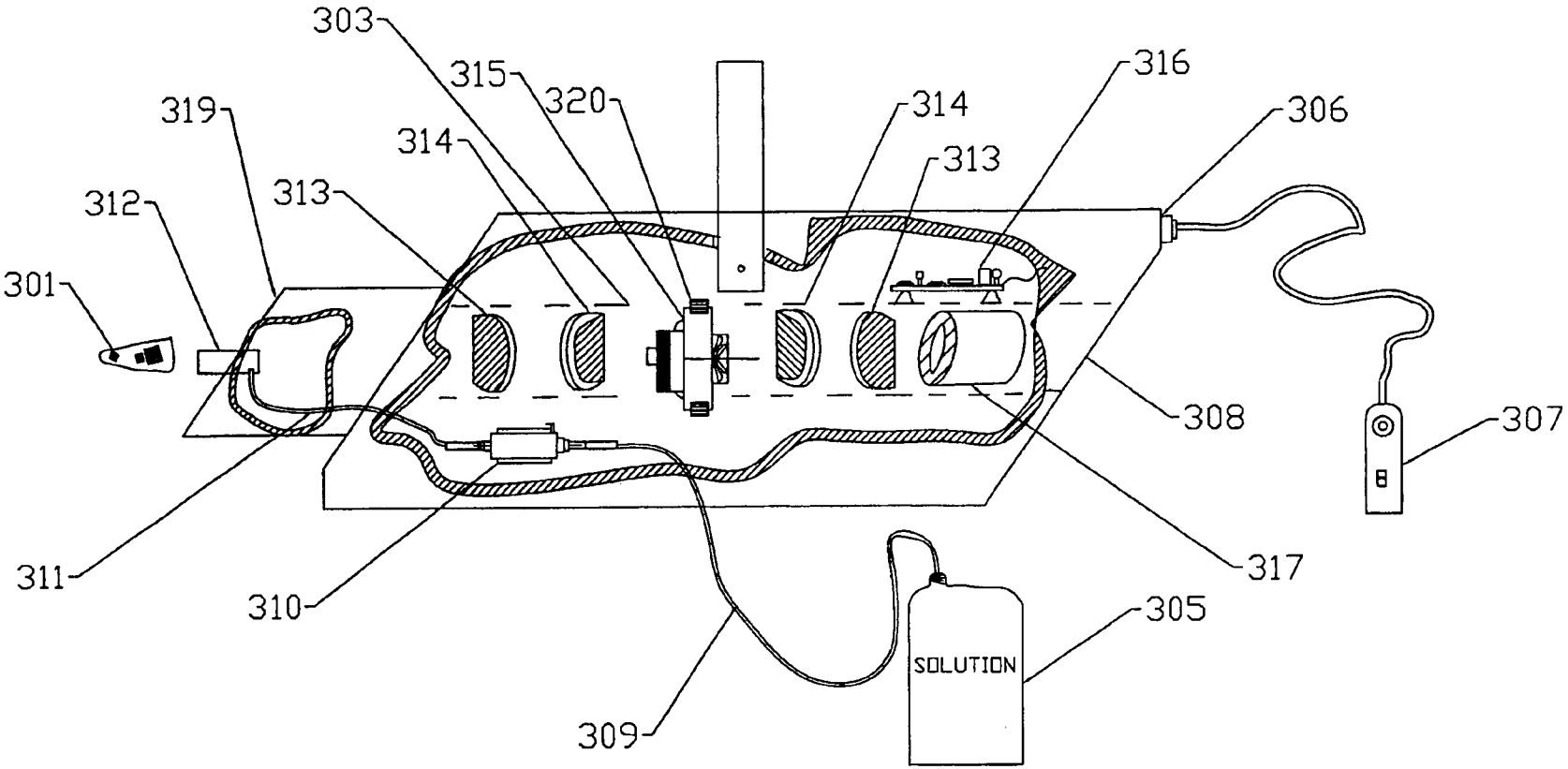
FIG. 9 illustrates the cutaway view of the apparatus demonstrating the internal sound dampening features of the invention.
Figure 10:
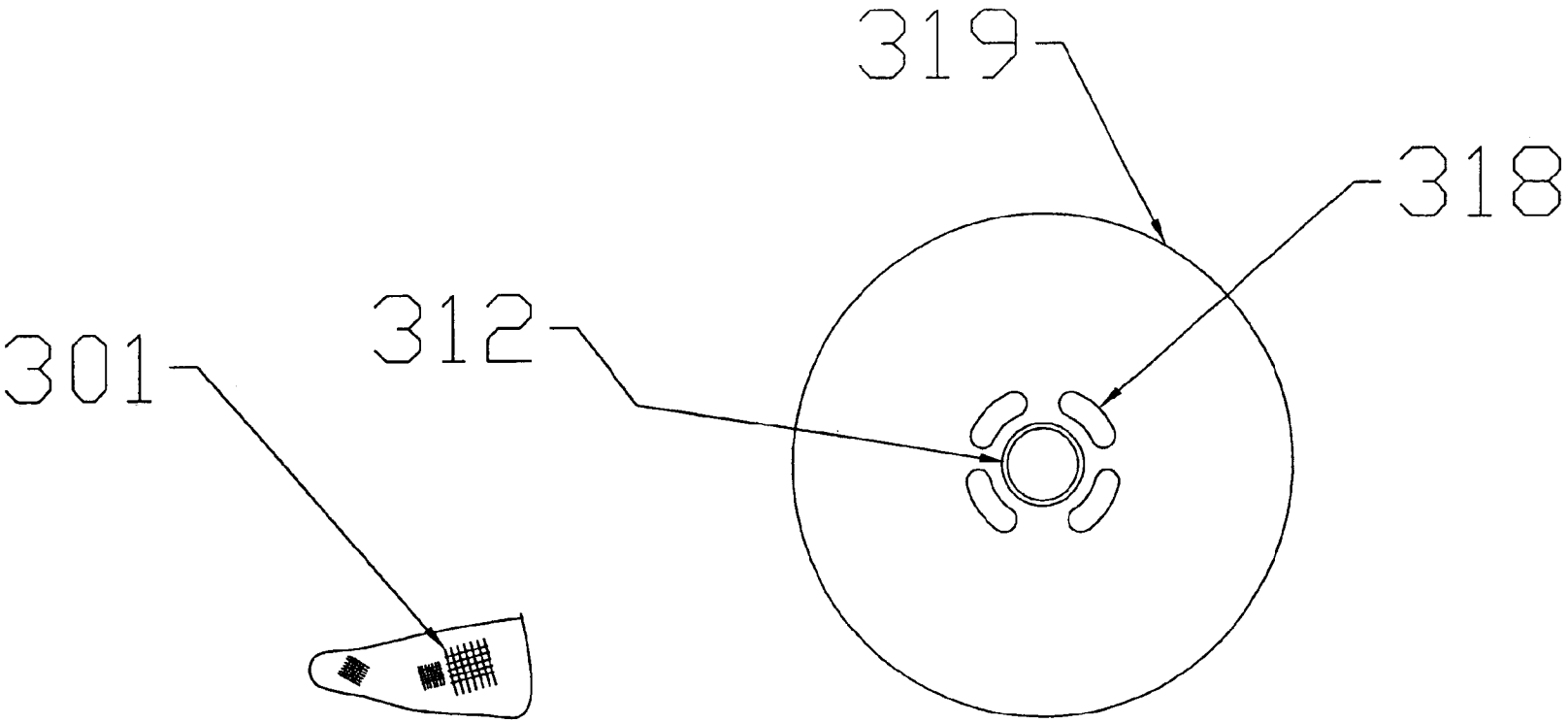
FIG. 10 illustrates the front discharge area sound reduction features

FIGS. 8–10 show schematics of an embodiment by which operating noise is reduced to 90 decibels (dB) or less. The embodiment will operate and produce output noise up to about 90 dB. It has further been discovered that in making the adaptations to reduce noise, the machine may be operated with a fan speed between 500–3000 cubic feet per minute (CFM)

FIG. 8 shows a schematic of one preferred embodiment. In this embodiment the illusionary snow solution 305 is drawn into a connecting hose 309 by an in-line pump. The external switch 306 is attached to housing 302 and allows for an operator to remotely start and stop the machine using remote control 307. Air enters through inlet 308 into a duct 303. In this embodiment, the machine has a support bracket 304 which allows, if desired, the operator to hang the machine from a support bracket 304. As previously described, the solution is pumped to a nozzle 301 which is attached to a nozzle discharge support 319. The aforementioned flake generator lifts the evaporative snow off the nozzle 319 and projects the evaporative snow away from the machine.

FIG. 10 shows a close up schematic of the nozzle which is placed on the flake generator on the discharge chamber 312 that is placed in the center of the nozzle support 319.

Nozzle support 319 is the outer portion of the flake generator described above. The nozzle support 319 also is formed with air portals 318 which facilitate the lifting of the evaporative snow flakes off nozzle 301 and project them away from the machine.

FIG. 9 shows a more detailed schematic of the parts in one preferred embodiment. Evaporative snow solution 305 is drawn into hose 309 and is pumped by pump 310 into an in-line hose 311 to a discharge nozzle 312, which saturates an attached fabric sock 301. High velocity air pushes the solution through the fabric sock 301 which generates flakes that are pushed off the fabric with high velocity air streaming through four slotted air portals 318. This air lifts the flakes into the air and sends them 10 to 60 feet away. In one embodiment the apparatus may be hung above a stage on the support bracket 304. An internal electrical fan/blower 315 provides the high velocity air that is directed towards the nozzle support 319. The air source is from the inlet area 308. The air velocity and pump rate are controlled by an internal circuit board 316 whose settings are controlled through external dip switches 306 or a remote controller 307. This allows an operator to control the sizes of the flakes and the distances they travel. Previously, this process of generating evaporative snow has created loud continuous noise levels that are unacceptable in the theatrical and film industries. The two significant noise sources have come from the fan/blower 315 or the rushing of air through narrow orifices 312, and 318. The preferred embodiment of the apparatus significantly reduces the noise levels from both sources. The machine now operates and produces external operating noise up to about 90 dB. Since the fan/blower 315 is such a strong source of noise, multiple methods of sound attenuation were employed for this evaporative snow machine. The main cutaway of the main housing 302 in FIG. 10 shows the noise attenuation features. The fan/blower 315 is contained with exterior foam 320 in a plastic duct 303. Since the fan/blower 135 is not rigidly mounted to plastic duct 303 or main housing 302, most of the noise energy travels through the interior of sealed plastic duct 303. Using noise attenuation calculations unique to the frequency of the fan/blower 315 used for the application, double walled foamed baffles 314 and single walled foamed baffles 313 are specifically located, spaced, and sized for a particular fan/blower 315, so as to absorb some sound energy, reflect some noise energy back into itself so that it counteracts new sound waves, and lowers the frequency of the sound waves emitted. Acoustical foam 317 is specifically designed for the baffles 313 and 314 and to line the interior of the plastic duct 303 to absorb and reflect some of the noise energy. The single wall foamed baffle 313 and double walled foam baffle 314 are located towards the inlet area side 308 side and towards the nozzle discharge area 319 side. The cutout opening on the single wall foamed baffle 313 and the double walled foamed baffle 314 are rotated 90 degrees from each other to create an overlap, so the sound waves do not have a direct path out of the interior of plastic duct 303. The baffles 313 and 314 overlap. Shape and spacing can be changed for the noise levels and frequencies of different models of fans/blowers 315. The preferred embodiment of this apparatus uses polyethylene for the plastic duct 303 and main housing 302 to minimize noise energy transfer through the main housing 302.

The second major source of noise in an evaporative snow machine is through the discharge area 319. When high velocity air compresses to travel through narrow orifices, whistles and jet noise are the result. In order to attenuate the noise in the discharge area 319, the in-line hose 311 is located and sized to remove most of it from the air flow, the air portals 318 were slotted and smoothed out to even out the air flow around the nozzle 301, and a particular nozzle fabric may be chosen to muffle the noise from the discharge nozzle 312. All other potential air discharge locations are sealed and rough edges smoothed to minimize the jet and whistle noises. This improved the efficiency of the evaporative snow machine and reduced the direct air velocity out the orifices, thus reducing the noise levels significantly.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A machine for producing an evaporative snow as small individualized particles which are easily dispersed, are free from agglomerates and leave no moisture and residue in the area of use, said machine comprised of a pump to deliver evaporative snow solution to a flake generator comprising of an impeller or impellers which causes the flakes to form on the surface of a sock, said flakes are dispersed by a sock by a airflow of 500–3000 cubic feet per minute, created by said impeller(s) and produces external noise level up to around 90 decibels measured three feet from the machine wherein external noise is reduced through: (a) direction air flow to a plastic duct: (b) sealing the duct with acoustical foam; (c) containing the fan in the duct in a non rigid mounting; (d) and by using special sized and shaped foam baffles to reflect and absorb noise energy, that are rotated to counteract a particular fan frequency.

2. The machine of claim 1 wherein said external noise levels are between about 50–80 decibels measured three feet from the machine.

3. The machine of claim 1 wherein said external noise levels are between about 50–70 decibels measured three feet from the machine.

4. The machine of claim 1 wherein said external noise levels are between about 50–60 decibels measured three feet from the machine.

5. The machine of claim 1 in which a pump operates at a rate of 1–4 ounces solution per minute.

6. The machine of claim 1 that uses multiple fans for generating the air flow.

7. The machine of claim 1 that uses various discharge nozzle or air portal shapes to reduce noise for evaporative snow production.

8. A machine described in claim 1 that modifies the outer case material, size, shape or insulation properties to reduce noise for evaporative snow generation.

* * * * *